US005221802A

United States Patent [19]

Konishi et al.

[11] Patent Number: 5,221,802

[45] Date of Patent: Jun. 22, 1993

[54] DEVICE FOR DETECTING CONTENTS OF A BASS AND CHORD ACCOMPANIMENT

[75] Inventors: Shinya Konishi; Toshihide Saito, both of Hamamatsu, Japan

[73] Assignee: Kawai Musical Inst. Mfg. Co., Ltd., Shizuoka, Japan

[21] Appl. No.: 706,010

[22] Filed: May 28, 1991

[30] Foreign Application Priority Data

May 26, 1990 [JP] Japan ..... 2-136447

[51] Int. Cl.[5] ..... G10H 7/00; G10H 1/38

[52] U.S. Cl. ..... 84/637; 84/613; 84/669; 84/715

[58] Field of Search ..... 84/634, 637, 666, 669, 84/712, 715, 610, 613, 650

[56] References Cited

U.S. PATENT DOCUMENTS

| | | | |
|---|---|---|---|
| 4,019,417 | 4/1977 | Carlson | 84/637 |
| 4,184,401 | 1/1980 | Hiyoshi | 84/636 |
| 4,282,786 | 8/1981 | Deutsch et al. | 84/613 |
| 4,315,451 | 2/1982 | Uchiyama et al. | 84/DIG. 12 X |
| 4,327,622 | 5/1982 | Aoki | 84/715 |
| 4,381,689 | 5/1983 | Oya | 84/637 |
| 4,864,907 | 9/1989 | Oguri | 84/637 |

*Primary Examiner*—William M. Shoop, Jr.
*Assistant Examiner*—Jeffrey W. Donels

[57] ABSTRACT

A device for detecting data of contents of accompaniment for use in an electronic musical instrument in which the detection of data representing contents of a bass accompaniment is effected independently of the detection of data representing contents of a chord accompaniment, by separately providing a first portion for indicating pitches composing a chord to be performed and a second portion for indicating the lowest pitch of a bass accompaniment pattern in a pitch indicating unit and detecting pitches indicated in the second portion. Thus, data representing contents of a bass accompaniment and data representing contents of a chord accompaniment can be separately detected, whereby the electronic musical instrument can perform a bass accompaniment independent of a chord accompaniment, and thus the variety of a performance can be increased. Further, in the device for detecting data of contents of an accompaniment, bit pattern data representing a chord to be performed as an accompaniment is generated by ORing data representing pitches of a predetermined octave-segment which correspond to pitches indicated by the pitch indicating unit in each octave-segment of the first portion, and the chord to be performed is detected by comparing the bit pattern data obtained as a result of the OR operation with bit pattern data corresponding to various chords stored in a memory, by sequentially shifting the bit pattern data obtained as the result of the OR operation, whereby even a chord in an inversion thereof can be easily and accurately detected.

35 Claims, 11 Drawing Sheets

FIG. 4

CHORD TABLE 71

| CHORD | CHORD BIT PATTERN DATA |
|---|---|
| Major | 0000 1001 0001 |
| Minor | 0000 1000 1001 |
| 7th | 0100 0001 0001<br>0100 1001 0001 |
| Minor 7th | 0100 0000 1001<br>0100 1000 1001 |
| Major 7th | 1000 0001 0001<br>1000 1001 0001 |
| Flat5 | 0000 0101 0001 |
| m7 Flat5 | 0100 0100 1001 |
| minor maj7 | 1000 1000 1001 |
| sus4 | 0000 1010 0001 |
| 7th sus4 | 0100 1010 0001 |
| add9 | 0000 1001 0101 |
| minor add9 | 0000 1000 1101 |
| 13th | 0110 0001 0001 |
| flat 13th | 0101 0001 0001 |
| Dim | 0010 0100 1001 |
| Aug | 0001 0001 0001 |

| B | A♯ | A | G♯ | G | F♯ | F | E | D♯ | D | C♯ | C |
|---|---|---|---|---|---|---|---|---|---|---|---|
| 0 | 0 | 0 | 0 | 0 | 0 | 0 | 0 | 0 | 0 | 0 | 1 |

BASS ROOT : C
CHORD ROOT : NOT DETECTED (CURRENTLY STORED ROOT MAINTAINED)
CHORD TYPE : NOT DETECTED (CURRENTLY STORED TYPE MAINTAINED)

| B | A♯ | A | G♯ | G | F♯ | F | E | D♯ | D | C♯ | C |
|---|---|---|---|---|---|---|---|---|---|---|---|
| 1 | 0 | 0 | 0 | 1 | 0 | 0 | 1 | 0 | 0 | 0 | 0 |

↓

| B | A♯ | A | G♯ | G | F♯ | F | E | D♯ | D | C♯ | C |
|---|---|---|---|---|---|---|---|---|---|---|---|
| 0 | 0 | 0 | 0 | 1 | 0 | 0 | 0 | 1 | 0 | 0 | 1 |

CYCLIC SHIFT C→C♯→D→D♯→E (4 TIMES)
MATCHED WITH BIT PATTERN CORRES. TO CHORD "Minor"

BASS ROOT : B
CHORD ROOT : E
CHORD TYPE : E m

BASS ROOT : C
CHORD ROOT : NOT DETECTED (CURRENTLY STORED ROOT MAINTAINED)
CHORD TYPE : NOT DETECTED (CURRENTLY STORED TYPE MAINTAINED)

| B | A# | A | G# | G | F# | F | E | D# | D | C# | C |
|---|---|---|---|---|---|---|---|---|---|---|---|
| 0 | 0 | 0 | 0 | 1 | 0 | 0 | 1 | 0 | 0 | 0 | 1 |

MATCHED WITH BIT PATTERN CORRES. TO CHORD "Major"

BASS ROOT : C
CHORD ROOT : C
CHORD TYPE : C

| B | A♯ | A | G♯ | G | F♯ | F | E | D♯ | D | C♯ | C |
|---|---|---|---|---|---|---|---|---|---|---|---|
| 1 | 0 | 0 | 0 | 1 | 0 | 0 | 1 | 0 | 1 | 0 | 0 |

↓

| B | A♯ | A | G♯ | G | F♯ | F | E | D♯ | D | C♯ | C |
|---|---|---|---|---|---|---|---|---|---|---|---|
| 0 | 1 | 0 | 0 | 1 | 0 | 0 | 0 | 1 | 0 | 0 | 1 |

CYCLIC SHIFT C→C♯→D→D♯→E (4 TIMES)
MATCHED WITH BIT PATTERN CORRES. TO CHORD"Minor7th"

BASS ROOT : D
CHORD ROOT : E
CHORD TYPE : E m 7

| B | A♯ | A | G♯ | G | F♯ | F | E | D♯ | D | C♯ | C |
|---|---|---|---|---|---|---|---|---|---|---|---|
| 0 | 0 | 0 | 0 | 1 | 0 | 0 | 1 | 0 | 0 | 0 | 1 |

MATCHED WITH BIT PATTERN CORRES. TO CHORD "Major"

BASS ROOT : CURRENTLY STORED ROOT MAINTAINED
CHORD ROOT : C
CHORD TYPE : C

BASS ROOT : C
CHORD ROOT : NOT DETECTED (CURRENTLY STORED ROOT MAINTAINED)
CHORD TYPE : NOT DETECTED (CURRENTLY STORED TYPE MAINTAINED)

| B | A♯ | A | G♯ | G | F♯ | F | E | D♯ | D | C♯ | C |
|---|---|---|---|---|---|---|---|---|---|---|---|
| 0 | 0 | 0 | 0 | 1 | 0 | 0 | 1 | 0 | 0 | 0 | 1 |

MATCHED WITH BIT PATTERN CORRES. TO CHORD "Major"

BASS ROOT : C
CHORD ROOT : C
CHORD TYPE : C

| B | A# | A | G# | G | F# | F | E | D# | D | C# | C |
|---|---|---|---|---|---|---|---|---|---|---|---|
| 0 | 0 | 1 | 0 | 0 | 0 | 0 | 1 | 0 | 0 | 0 | 1 |

↓

| B | A# | A | G# | G | F# | F | E | D# | D | C# | C |
|---|---|---|---|---|---|---|---|---|---|---|---|
| 0 | 0 | 0 | 0 | 1 | 0 | 0 | 0 | 1 | 0 | 0 | 1 |

CYCLIC SHIFT C→C# →D→D# →E→F→F#
→G→G# →A (9 TIMES)

MATCHED WITH BIT PATTERN CORRES. TO CHORD "Minor"

BASS ROOT : C
CHORD ROOT : A
CHORD TYPE : A m

| B | A# | A | G# | G | F# | F | E | D# | D | C# | C |
|---|---|---|---|---|---|---|---|---|---|---|---|
| 0 | 0 | 0 | 0 | 1 | 0 | 0 | 1 | 0 | 0 | 0 | 1 |

MATCHED WITH BIT PATTERN CORRES. TO CHORD "Major"

BASS ROOT : CURRENTLY STORED ROOT MAINTAINED
CHORD ROOT : C
CHORD TYPE : C

NOT MATCHED WITH ANY CHORD

BASS ROOT : F
CHORD ROOT : NOT DETECTED
CHORD TYPE : NOT DETECTED

FIG. 6 (1)

(a) C E G C̄ G E C — BASIC CHORD ACPAN. PATTERN (C)

(b) D F# A D̄ A F# D — DEVELOPED PATTERN (D)

FIG. 6 (2)

(a) C G C G — BASIC BASS ACPAN. PATTERN (C)

(b) D A D A — DEVELOPED PATTERN (D)

FIG. 6 (3)

(a) C G C G — BASIC BASS ACPAN. PATTERN (C)

(b) B $G^b$ B $G^b$ — FRACTIONAL-CHORD BASS ACPAN. PATTERN ($C_7/B^b$)

FIG. 6 (4)

(a) BASIC CHORD ACPAN. PATTERN (b) PRESSED KEYS (NO CHORD ACPAN. IS PERFORMED)

(c) DEVELOPED PATTERN

DEVICE FOR DETECTING CONTENTS OF A BASS AND CHORD ACCOMPANIMENT

BACKGROUND OF THE INVENTION

1. Field of the Invention

This invention generally relates to an electronic musical instrument, and more particularly, to a device (hereunder sometimes referred to simply as an accompaniment detecting device) for detecting the contents of an accompaniment (for example, a chord accompaniment or a bass accompaniment) for use in an electronic musical instrument.

2. Description of the Related Art

Accompaniment detecting devices are now widely used in automatic instruments and the like. Conventional automatic instruments and the like, and most of the many conventional automatic instruments now manufactured automatically play chords by using a part of the keys of a keyboard thereof corresponding to a succession of the lowest pitches as a portion (hereunder referred to as a chord detecting portion) of keys for detecting chords, by also using the other portions of the keys of the keyboard as a portion of the keys for playing melodies, and by detecting which keys of the chord detecting portion are pressed. Further, such conventional automatic instruments are adapted to automatically play a chord with an automatic rhythm accompaniment, obtained by simply continuing to press keys corresponding to pitches composing the chord.

The accompaniment detecting devices of the conventional automatic instruments, however, have problems in that it is difficult to designate a bass accompaniment independently of a chord accompaniment and that it is hard to discriminate among a root-position chord and its inversions which of the lowest-sounding pitches are different from the root of the root-position chord. The present invention is created to resolve the above described problems of the conventional accompaniment detecting devices.

Accordingly, an object of the present invention is to provide an accompaniment detecting device which can easily designate a bass accompaniment independent of a chord accompaniment, and accurately detect a chord and its inversion.

SUMMARY OF THE INVENTION

To achieve the foregoing object, and in accordance with a first aspect of the present invention, there is provided a device for detecting the contents of an accompaniment, which includes a plurality of pitch indicating means for indicating pitches of musical tones. The plurality of the pitch indicating means includes a first portion for detecting a chord to be performed as an accompaniment and a second portion for detecting a bass to be performed as an accompaniment; these first and second portions sometimes overlapping one another. The device for detecting the contents of an accompaniment further comprises a pitches detecting means for detecting pitches indicated by the pitch indicating means of the first portion, a chord detecting means for detecting a chord according to the pitches detected by the pitch detecting means, and a bass detecting means for detecting the lowest pitch of pitches composing a bass accompaniment pattern, in accordance with the pitches indicated by the pitch indicating means of the second portion.

In accordance with a second aspect of the present invention, there is provided a device for detecting the contents of an accompaniment, which includes a names-of-pitches-composing-chords storing means for storing bit pattern data corresponding to the pitch names of pitches composing chords and a plurality of pitches indicating means for indicating the pitches of musical tones; the plurality of pitches indicating means including a chord-root detecting portion for detecting a root of a chord to be played as an accompaniment. The device for detecting the contents of an accompaniment further comprises a pitch name detecting means for detecting the pitch names of pitches which correspond to a pitch indicating means of a predetermined octave-segment other than a pitch indicating means placed at an end thereof, and further, correspond to pitches indicated by the pitch indicating means of the chord-detecting portion (namely, for detecting the names of pitch classes corresponding to pitches indicated by the pitch indicating means of the chord-detecting portion) and for generating bit pattern data corresponding to the detected pitch names and chord detecting, means for detecting a chord to be played as an accompaniment by comparing the bit pattern data corresponding to the pitch names detected by the pitch name detecting means with bit pattern data corresponding to pitch names stored in the names-of-pitches-composing-chords storing means, by sequentially shifting the bit pattern data corresponding to the pitch names detected by the pitch name detecting means or the bit pattern data corresponding to pitch names stored in said names-of-pitches-composing-chords storing means.

BRIEF DESCRIPTION OF THE DRAWINGS

Other features, objects and advantages of the present invention will become apparent from the following description of a preferred embodiment with reference to the drawings in which like reference characters designate like or corresponding parts throughout several views, and in which:

FIG. 4 is a diagram illustrating data stored in a chord table 71;

FIGS. 6(1) to 6(4) are diagrams illustrating examples of fundamental bass and chord accompaniment patterns, and of the developed patterns thereof.

DESCRIPTION OF THE PREFERRED EMBODIMENT

Hereinafter, a preferred embodiment of the present invention will be described in detail with reference to the accompanying drawings.

SUMMARY OF THE PREFERRED EMBODIMENTS

In this embodiment, when an operation of turning on a key of a keyboard (hereunder referred to as a "key on" operation) is performed on one of the keys of a portion (hereinafter referred to as a bass-root detecting portion) 11*a* of the keyboard 11 of FIG. 2, which is used to detect a base root, of the keyboard in step S1 of FIG. 1, data representing a base root stored in a working memory 61 is updated. When a "key on" operation is performed on a key of a chord detecting portion 11*b*, a logical OR among octave-chord data of all octave-segments of the keyboard is carried out in steps S5 and S6. Note, in the instant specification, octave-chord data of an octave-segment of the keyboard is defined as data which represents on-states or off-states of keys respectively corresponding to twelve pitches (e.g., C, C♯, D, D♯, E, F, F♯, G, G♯, A, A♯, and B in the case of C major) of a specific octave-segment (namely, the C above the specific octave-segment is not included). Further, in the instant specification, it is assumed that each pair of adjoining octave-segments has a key placed at an end of one of the octave-segments in common; i.e., if an octave-segment spans from C1 to C2, the next octave-segment spans from C2 to C3. Next, a bit pattern of a resultant ORed octave-chord (hereunder referred to as a synthesized octave-chord) or another bit pattern obtained by effecting a ring shift (namely, a cyclic shift) of the synthesized octave-chord in step S10, is compared with a bit pattern of a chord represented by data stored in a chord table of FIG. 4 in step S9. If there is a match there between, a chord type represented by data stored in the memory 61 is updated. Further, a chord root represented by data stored in the memory 61 is updated in response to each ring shift in step S11 and is also updated in step S13.

1. CONSTRUCTION OF ENTIRE MUSICAL INSTRUMENT

Figure 2:
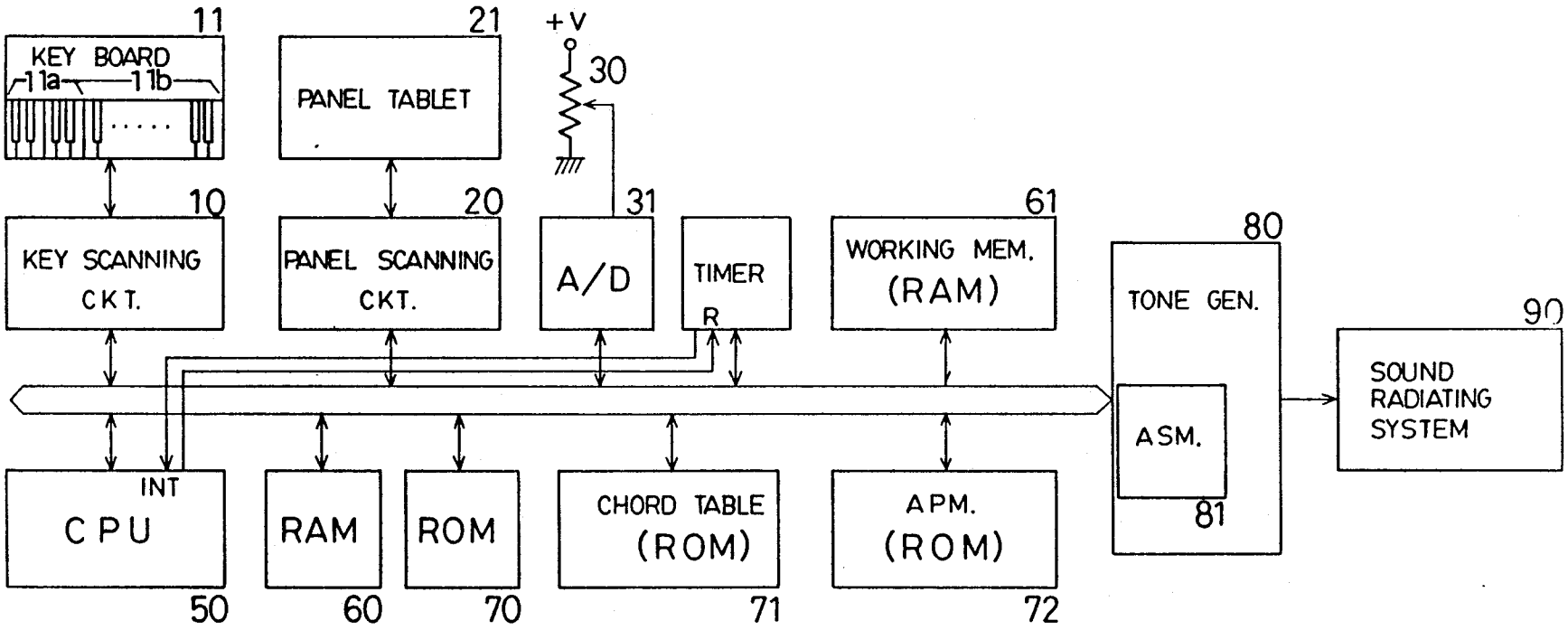
FIG. 2 is a circuit diagram showing the construction of an entire electronic musical instrument provided with an accompaniment detecting device.

FIG. 2 shows the construction of an entire musical instrument provided with an accompaniment detecting device embodying the present invention.

In the keyboard 11, the bass-root detecting portion 11*a* is a portion consisting of keys corresponding to pitches C1 to B1 of an octave-segment, and a detection of a bass root is carried out by the bass-root detecting portion 11*a*. Moreover, the entire keyboard 11 including the portion 11*a* is employed as the chord detecting portion 11*b* in which the detection of a chord root and of a chord type is effected. An on-state or off-state of each key of this keyboard 11 is scanned by a key scanning circuit 10, and the results of the scan written to a RAM 60. Further, in the key scanning circuit 10, touch data varying according to the speed or strength by which a key is pressed down is also detected. The RAM 60 is used as a stack pointer for temporarily saving a program count value (i.e., contents of a program counter (not shown)) therein. Note, pitches may be indicated by the keyboard of a string instrument, a wind instrument, a percussion instrument, a computer system or the like, instead of the keyboard 11. In addition, a panel tablet 21 is provided with many switches for selecting timbres, effects and the like as will be described later, and an on-state or off-state of each switch is scanned by the key scanning circuit 20, and the results of this scan are also written to the RAM 60.

Based on the results of the scan of the keyboard 11 and the tablet 21, various data required to radiate musical sounds corresponding to each channel is set in an assignment storing memory 81 of a tone generator 80, musical sound signals are generated according to the data thus set in the memory 81, and musical sounds represented by the musical sound signals are radiated from a sound radiating system 90. When a "key on" operation is performed on a key of the bass-root detecting portion 11*a* of the keyboard 11, the pitch name of a pitch corresponding to the turned-on key to be detected by the scan effected by the key scanning circuit 10 is stored in the working memory 61. Then, an automatic performance of a bass accompaniment pattern (hereunder referred to as an automatic bass accompaniment) is effected by employing the pitch having the stored pitch name as a bass root. Note, where prior to this "key on" operation another "key on" operation has been already performed on a key corresponding to a lower pitch, the contents of an automatic bass accompaniment which is being effected by employing this lower pitch as a bass root is not changed. Moreover, automatic bass performance data representing a bass accompaniment pattern to be automatically performed is stored in an automatic performance memory 72.

The automatic bass performance data of this embodiment includes combinations of pitch data and time value data. Further, the pitch data is shifted and modified according to the detected bass root. The modification of the pitch data is effected as follows. For example, where the stored automatic bass performance data represents a bass accompaniment pattern, in which a pitch C1 is employed as an original bass root (namely, a reference pitch), and the actually detected bass root is E1, the difference between data elements respectively representing the pitches E1 and C1 is subtracted from or added to each of all data elements of the pitch data of the automatic bass performance data, and the thus modified pitch data is sent to the assignment storing memory 81 of the tone generator 80, together with the timbre data and the touch data.

FIGS. 6(2) and 6(3) illustrate examples of such a modification of the pitch data. FIG. 6(2)(*a*) shows a base accompaniment pattern, which is in the basic form and is represented by the automatic bass performance data stored in the automatic performance memory 72. Namely, the stored pattern is composed of a sequence of pitches C1, G0, C1 and G0, each of which has a time value (namely, the duration of a corresponding sound) indicated by a half note. When a key corresponding to a pitch D1 of the bass-root detecting portion 11*a* of the keyboard 11 is pressed down, the difference between pitches D1 and C1, i.e., an interval of a whole tone, is added to each of the pitches respectively represented by all data elements of the pitch data, and as a result, the bass accompaniment pattern is changed to a developed pattern comprised of a sequence of musical tones respectively having pitches D1, A0, D1 and A0 of FIG. 6(2)(*b*). In the case of keys corresponding to pitches lower than C1 of the bass-root detecting portion 11*a*, when a key corresponding to a pitch B0 is pressed down, the difference between pitches B0 and C1, i.e., an interval of a semitone, is subtracted from each of the pitches respectively represented by all data elements of the pitch data. As a result, the bass accompaniment pattern of FIG. 6(2)(*a*) (namely, that of FIG. 6(3)(*a*)) is changed to a pattern comprised of a sequence of musical tones respectively having the pitches B0, G0♭, B0 and G0♭ of FIG. 6(3)(*b*). Further, the time value data is sent to a timer 40, and after a lapse of time corresponding to the time value indicated by the time value data, an interrupt signal is input to a central processor unit (CPU) 50 which in response to the interrupt signal, issues a command that a reading of the next automatic bass performance data should be effected. In this timer 40, time value data of eight tones (or sixteen tones at most) can be preset by carrying out a time sharing process.

When "key on" operations are newly performed on keys of the chord detecting portion 11*b* of the keyboard 11, data representing all pitch names of pitches corresponding to the operated keys, which are detected by the key scanning circuit 10, is stored in the working memory 61. Note that the data representing this group of the pitch names is a chord (hereunder referred to as a synthesized octave-chord) synthesized by replacing each of the pitch names of the pitches, which correspond to the operated keys and are separated from corresponding pitches belonging to a predetermined octave-segment by one or more octaves, with the pitch name of the corresponding pitch of the predetermined octave-segment. Then, the synthesized octave-chord is compared with data (hereinafter referred to as chord bit pattern data) representing bit patterns of chords to be used in a chord accompaniment, by serially shifting the bit pattern thereof to search for a chord having the same bit pattern, and thus the chord root, as well as the chord type, of the detected chord is discriminated.

As illustrated in FIG. 4, the chord bit pattern data is 12-bit data, and the bits of the chord bit pattern data correspond to twelve pitches C, C#, D, D#, E, F, . . . , A, A# and B, respectively. Bits corresponding to pitches composing each of the chords "Major", "Minor", "7th", etc. are made 1; and the other bits are made 0. The chord detected as above described is stored in the working memory 61, and thereafter, an automatic chord accompaniment employing the thus stored chord is performed. The automatic chord performance data representing a chord accompaniment pattern to be automatically performed is stored in the automatic performance memory 72.

The automatic chord performance data of this embodiment also includes combinations of pitch data and time value data. Further, the pitch data of the automatic chord data is shifted and modified according to the detected chord root. The modification of the pitch data is effected in the same way as for the pitch data of the automatic bass performance data. Namely, for example, where the stored automatic chord performance data represents a chord accompaniment pattern, in which a pitch C2 is employed as an original chord root (namely, a reference pitch), and the actually detected bass root is G1, the difference between data elements respectively representing the pitches G1 and C2 is added to or subtracted from each of all data elements of the pitch data of the automatic chord performance data. The thus modified pitch data is sent to the assignment storing memory 81 of the tone generator 80, together with the timbre data and the touch data.

FIG. 6(1) illustrates an example of such a modification of the pitch data. FIG. 6(1)(*a*) shows a chord accompaniment pattern, which is in the basic form and is represented by the automatic chord performance data stored in the automatic performance memory 72. Namely, the stored pattern is composed of a sequence of pitches C2, E2, G2, C3, G2, E2 and C2, each of which has a time value indicated by a quarter note. When a key corresponding to a pitch D2 of the chord-root detecting portion 11*b* of the keyboard 11 is pressed down, the difference between pitches D2 and C2, i.e., an interval of a whole tone, is added to each of pitches respectively represented by all data elements of the pitch data, and as a result, the chord accompaniment pattern is changed to a developed pattern comprised of a sequence of musical tones respectively having pitches D2, F2#, A2 D3, A2, F2# and D2 of FIG. 6(1)(*b*). Further, the time value data is sent to the timer 40, and after a lapse of a time corresponding to the time valve indicated by the time value data, an interrupt signal is input to the CPU 50 which, in response to the interrupt signal, sends a command that a reading of the next automatic bass performance data should be carried out. As stated above, in this timer 40, time value data of eight tones (or sixteen tones at most) can be preset by carrying out a time sharing process.

Note, where a key corresponding to a pitch (e.g., C2, E2, F2 or B2) which does not belong to any chord is turned on (and thus the detection of a chord cannot be made), the time value data is sent to the timer 40 in the same way as when the detection of a chord can be made, but with regard to the pitch data, only data representing the pitch (e.g., C2, E2, F2 and B2) corresponding to the pressed key is sent to the assignment memory 81. Accordingly, a chord accompaniment pattern stored in the automatic performance memory 72 to be automatically performed is changed from a basic pattern of, for example, FIG. 6(4)(*a*) to a developed pattern of FIG. 6(4)(*c*), and the musical instrument performs a chord accompaniment based on the time value determined according to the automatic chord performance data and the pitch corresponding to the operated key of the chord detecting portion 11*a* of the keyboard 11.

A voltage signal representing a voltage level set by a control device (namely, a variable resistor) 30 for the tempo is converted by an analog-to-digital (A/D) converter 31 into a signal representing digital data, the digital data is then input to the CPU 50, and in accordance with the digital data, the CPU 50 controls the frequency of a pulse signal to be input to the timer 40, whereby a tempo of an automatic bass accompaniment or an automatic chord accompaniment is changed.

In addition, a large number of tone number data, envelope characteristic data and hold data, which are established according to timbres and compasses used in the musical instrument and depend on whether or not a sustain effect is present, and programs for performing various kinds of processes to be executed by the CPU 50, are stored in a read-only memory (ROM) 70. Note, the working memory 61 may be included in the RAM 60, and a chord table 71 (to be described later) and the automatic performance memory 72 may be included in the ROM 70.

2. WORKING MEMORY 61

Figure 3:
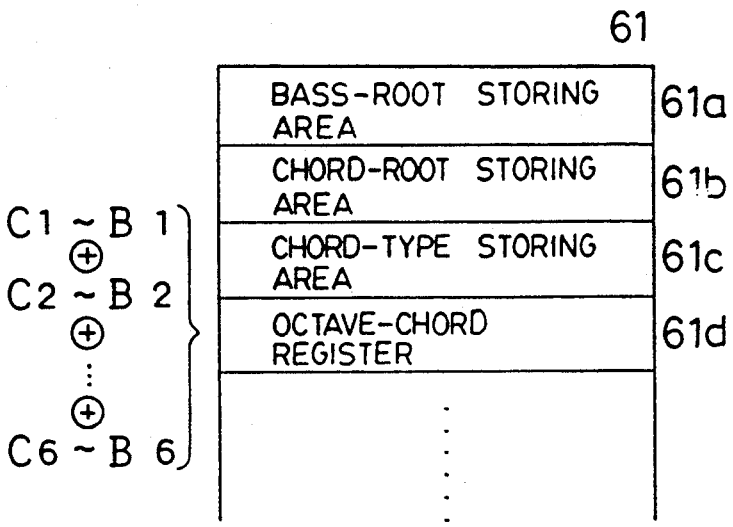
FIG. 3 is a diagram illustrating a working memory 61.

FIG. 3 shows the working memory 61 of this embodiment, which includes a bass-root storing area 61*a*, a chord-root storing area 61*b*, a chord-type storing area 61*c* and an octave-chord register 61*d*. The bass-root storing area 61*a* stores the bass root corresponding to the key detected in the bass-root detecting portion 11*a* of the keyboard 11 is stored; the chord root and the chord type which have been detected in the chord detecting portion 11*b* of the keyboard 11 are respectively stored in the chord-root storing area 61*b* and the chord-type storing area 61*c*. ; and octave-chord data representing octave-chords which each indicate on-states/off-states of keys corresponding to pitches of a corresponding octave-segment as above described, is first stored in the octave-chord register 61*d*, and finally, data designating the synthesized chord obtained by effecting logical OR operations among the octave-chord data of all octave-segments as described above is stored.

3. CHORD TABLE 71

FIG. 4 illustrates the chord table 71, wherein chord bit pattern data, which represents bit patterns (hereunder referred to as chord bit patterns) corresponding to the chords "Major", "Minor", "7th" . . . , is stored. In each chord bit pattern, bits corresponding to the pitch names of musical sounds composing a corresponding one of the chords are made one, and the other bits thereof are zero. Twelve bits of each chord bit pattern data corresponds to pitch names C, C♯, D, D♯, . . . and B, from right to left, as viewed in FIG. 4, respectively. Note, each chord bit pattern data stored in the chord table 71 of FIG. 4 represents a chord bit pattern corresponding to each of the chords in the root position, but chord bit pattern data representing chord bit patterns of the chords in an inversion thereof may be stored in the chord table 71. Further, in this embodiment, the chord root is C, but a pitch other than C may be employed as a chord root.

4. PROCESSING OF DETECTING A BASS-ROOT AND A CHORD-ROOT

Figure 1:
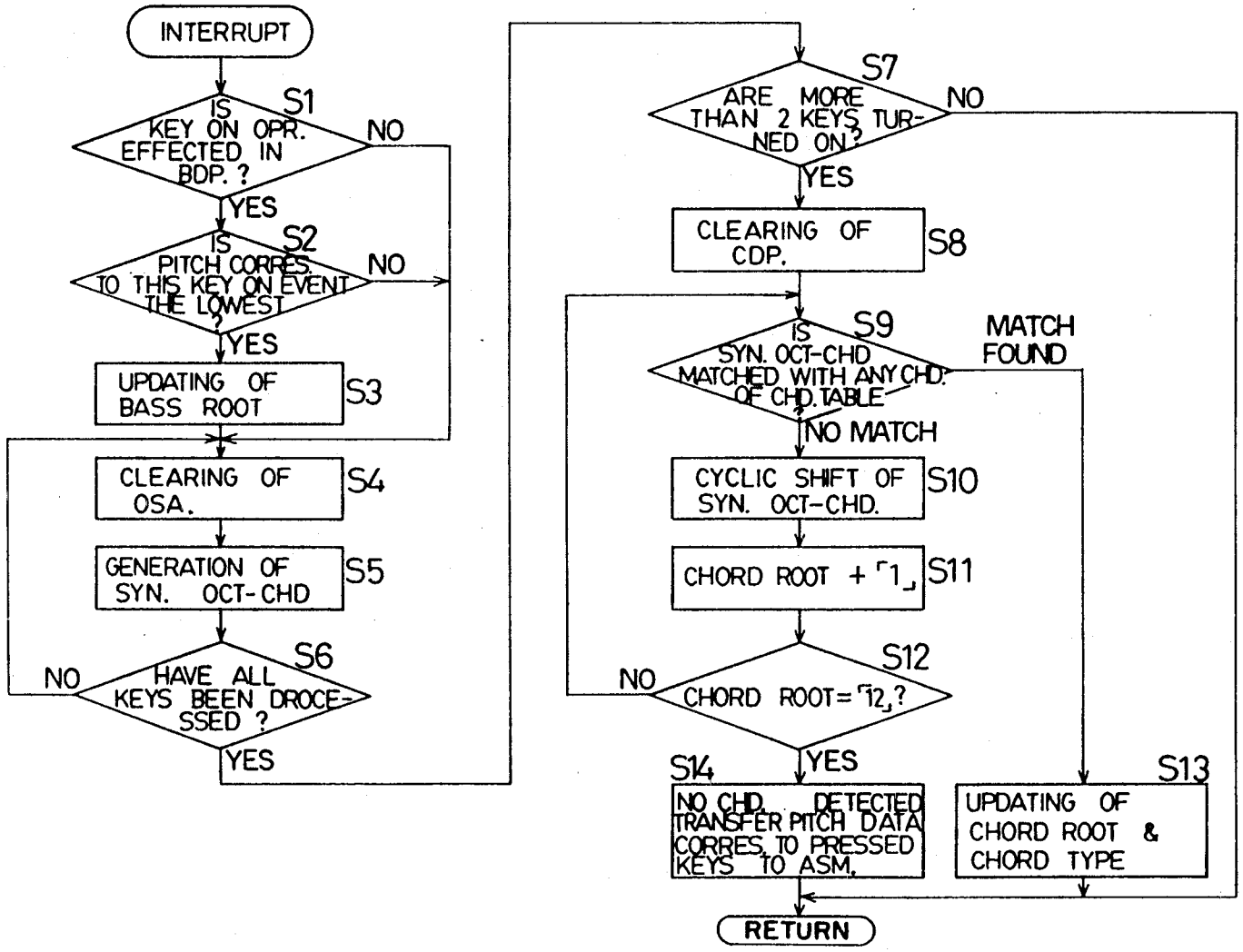
FIG. 1 is a flowchart of a program for performing a discrimination and detection processing of the lowest pitch of pitches composing a bass accompaniment pattern (hereunder referred to simply as a bass root), the root of a chord (hereunder referred to simply as a chord root) used in a chord accompaniment, and the type of chord (hereunder referred to simply as a chord type)

FIG. 1 is a flowchart of a program for performing a discrimination and detection processing of a bass root, a chord root and a chord type. This program is executed by the CPU 50. Further, the execution of this program is started by an interrupt, which is caused by an occurrence of a new "key on" event in the keyboard 11, to the CPU 50.

Namely, when a new "key on" event occurs, the CPU 50 determines whether or not this "key on" event has occurred in the bass-root detecting portion 11*a* in step S1. If so, in step S2 it is determined whether or not a pitch corresponding to the key pressed at the time of the occurrence of the latest "key on" event is lower than any other pitches corresponding to keys which are currently turned on. If so, a bass root represented by data stored in the bass-root storing area 61*a* of the working memory 61 is updated in step S3 by employing the lowest pitch (i.e., the pitch corresponding to the key pressed at the time of the occurrence of the latest "key on" event) as a new bass root and replacing the stored bass root with the new bass root.

Namely, the detection of a bass root is performed independently of that of a chord root, and therefore, a bass accompaniment can be freely performed independently of a chord accompaniment. The reason why it is determined in step S2 whether or not the pitch corresponding to the latest "key on" event in the bass-root detecting portion is the lowest, is that a bass accompaniment is usually the lowest part in all parts of a performance, but it is of course apparent that it may be determined whether or not the pitch corresponding to th latest "key on" event in the bass-root detecting portion is the second or third lowest. Note, if the determination in step S1 or S2 is negative (i.e., NO), the base root stored in the area 61*a* is not updated.

Next, the CPU 50 clears the octave-chord register 61*d* of the working memory 61 in step S4, and then in step S5, the CPU 50 writes the octave-chord data in sequence to the octave-chord register 61*d*, and at that time, the octave-chord data to be written is ORed with data previously stored in the octave-chord. Subsequently, in step S6, the same route and logical-sum operations are performed on each group of pitches (C1 to B1; C2 to B2; C3 to B3; C4 to B4; C5 to B5; C6 to B6; C7 to B7; . . . ) included in octave-segments in the chord-root detecting portion 11*b*, and accordingly, a synthesized octave-chord representing bit patterns corresponding to keys turned on in the chord-root detecting portion 11*b* is generated.

Next, in step S7, the CPU 50 determines whether more than two bits of "1" are present in the synthesized octave-chord (i.e., whether more than two keys are simultaneously pressed down). If less than three keys are simultaneously pressed down, no chord to be used for accompaniment is detected, and therefore, neither a processing of detecting a chord root nor a processing of detecting a bass root is performed. Note, in step S7 the CPU 50 may determine whether two or more keys are simultaneously pressed down. Alternatively, the processing of step S7 may be omitted, and thus a chord may be specified by detecting only one pressed key.

If more than two keys are pressed down at the same time, the chord-root represented by chord root data stored in the chord-root storing area 61*b* of the working memory 61 is cleared at step S8, and then the chord bit pattern data of each chord is serially read from the chord table 71, and in step S9, the read chord bit pattern data is compared with the synthesized octave-chord. If there is no match, the synthesized octave-chord held in the octave-chord register 61*d* is shifted in step S10 to the right by one bit, by effecting a ring shift, and subsequently, a value indicated by the chord-root data stored in the chord-root storing area 61*b* is increased by 1 in step S11. Thereafter, the comparison of the synthesized octave-chord with each of the chord bit pattern data is repeated (see step S12). By performing the ring shift of the synthesized octave-chord in step S10*a*, a chord in an inversion thereof can be detected. Moreover, a chord root can be determined from the number of times the ring shift is carried out.

If a match is found in step S9, a chord type is stored in the chord table 71 corresponding to the found chord bit pattern data is written to the chord-type storing area of the working memory 61, and a chord root is determined from corresponding data stored in the chord-root storing area 61*b* in step S13. For example, if the corresponding data stored in the chord-root storing area 61*b* is 0, the chord root is set to pitch C, and further, if the corresponding data is 1, the chord root is set to pitch C♯. If the corresponding data is 2, the chord root is set to pitch B.

If no match is found in step S9, even where the chord root is 12 in step S12, it is determined in step S14 that a chord is not detected, and therefore, a process of updating the chord root and the chord type in step S13 is not affected. Further, data representing pitches which correspond to the pressed keys is transferred in step S14 to assignment storing memory 81. Nevertheless, the time value data is read from the automatic performance memory 72 and is transferred to the timer 40, in the same way as when a match is found, and consequently, a chord is formed. Therefore, a chord accompaniment is performed by using the time value based on the bit pattern of the automatic chord performance data and the pitches corresponding to the pressed keys of the chord-root detecting portion 11*a*. Namely, in step S14 of this embodiment, the accompaniment is performed by using all pitches corresponding to the pressed keys. Nevertheless, the accompaniment may be performed by using only a part of the pitches corresponding to the pressed keys (e.g., the first to third lowest pitches, the three lowest pitches other than the bass root, or pitches corresponding to three of the keys pressed before the other thereof). Further, even where it is determined in step S7 that less than three keys are turned on (i.e., the number of the pressed keys is one or two), an accompaniment may be performed after step S7.

5. EXAMPLES OF DETECTION OF A BASS-ROOT, A CHORD-ROOT AND A CHORD TYPE

Figure 5:
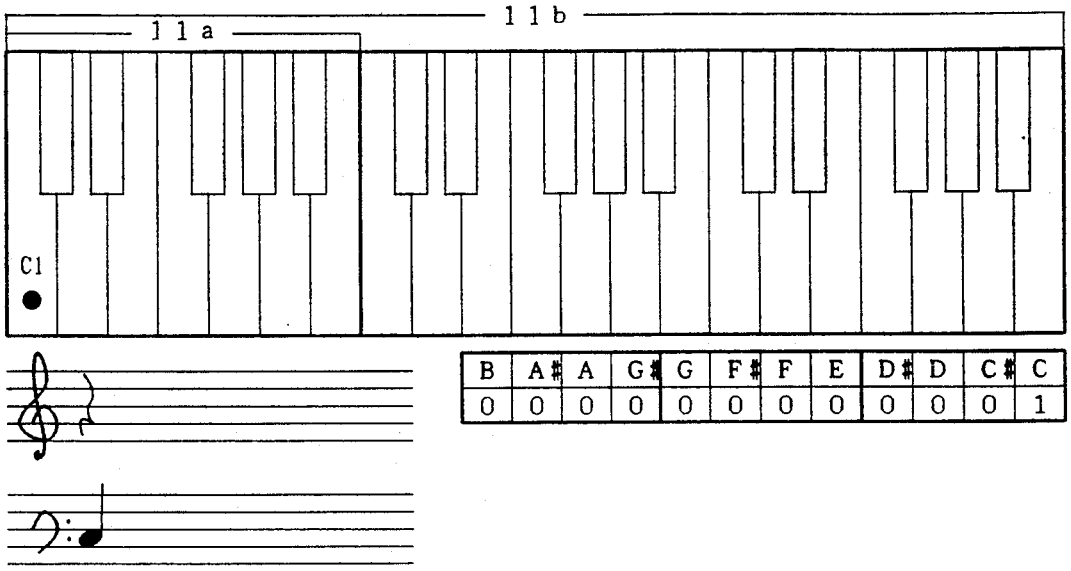
FIGS. 5(1) to 5(11) are diagrams illustrating examples of the discrimination and detection processing of a bass root, a chord root and a chord type.
Figure 5:
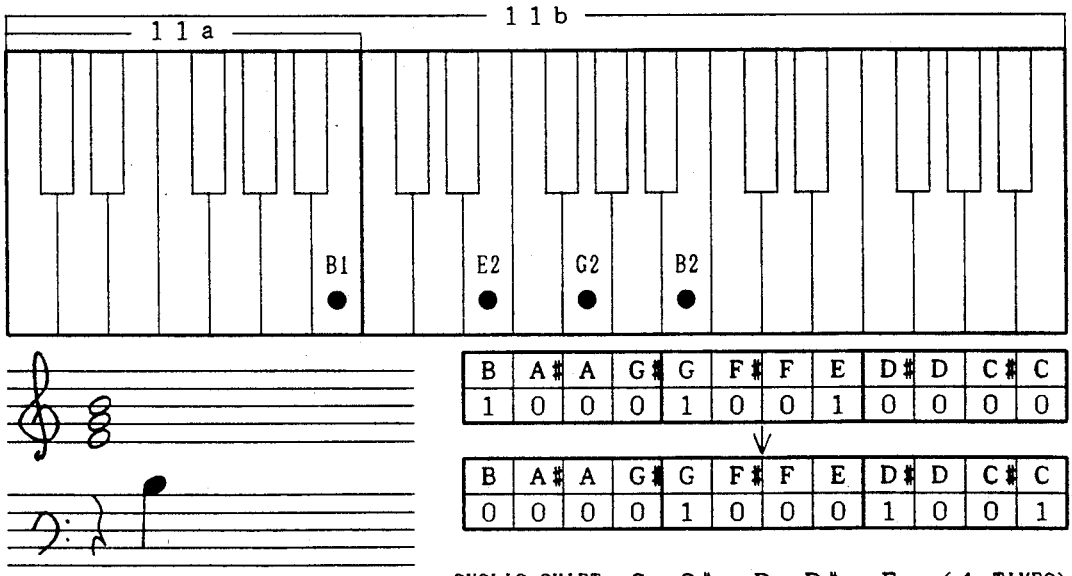
Figure 5:
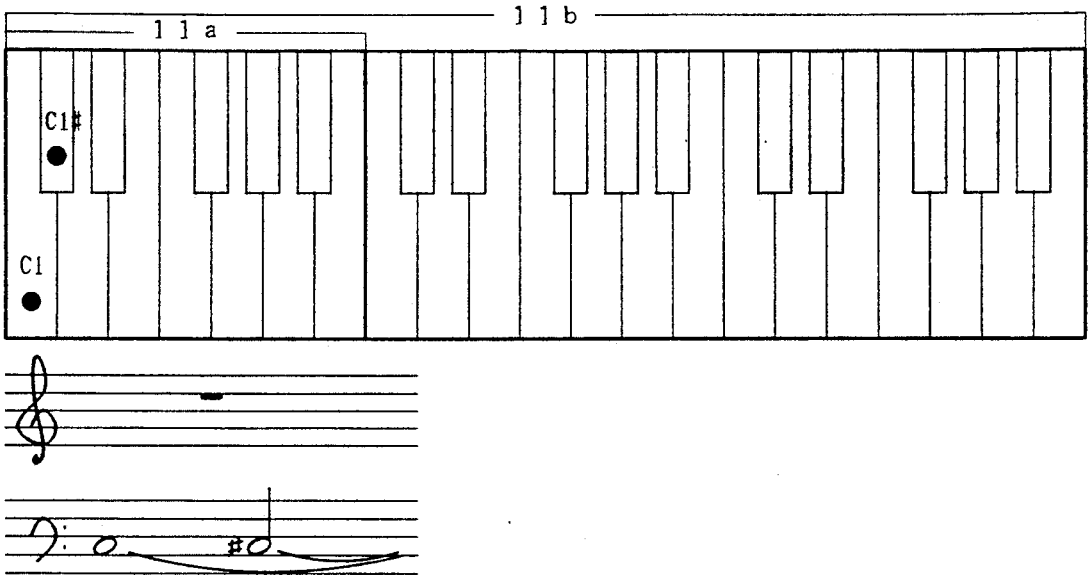
Figure 5:
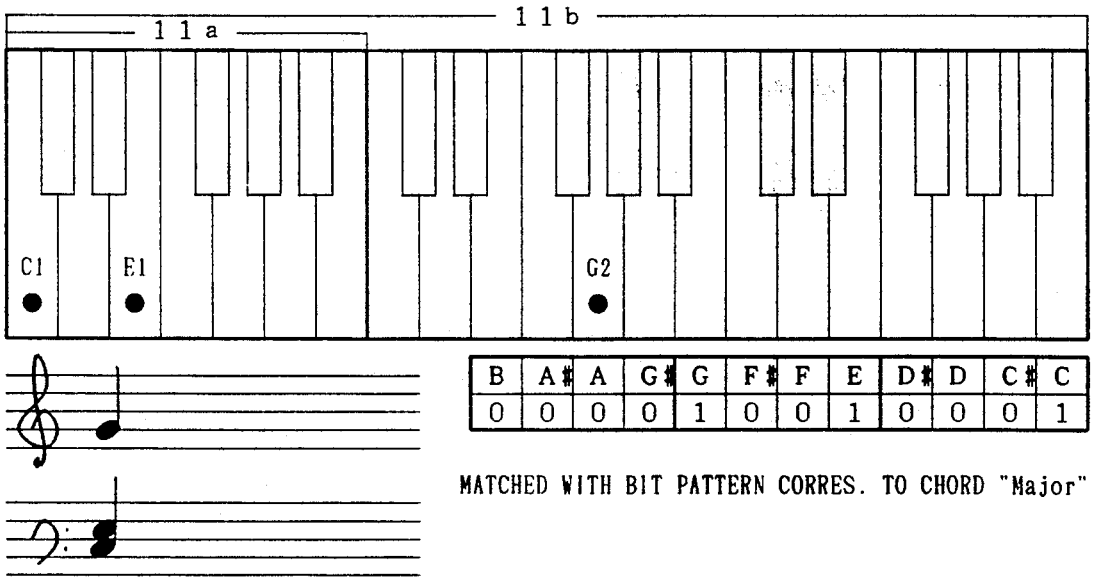
Figure 5:
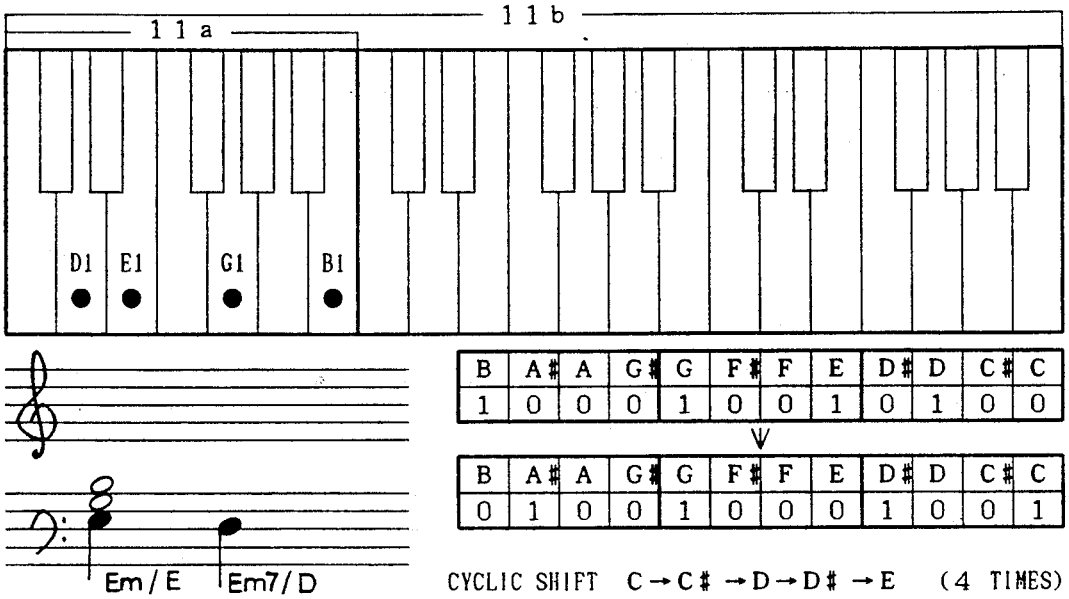
Figure 5:
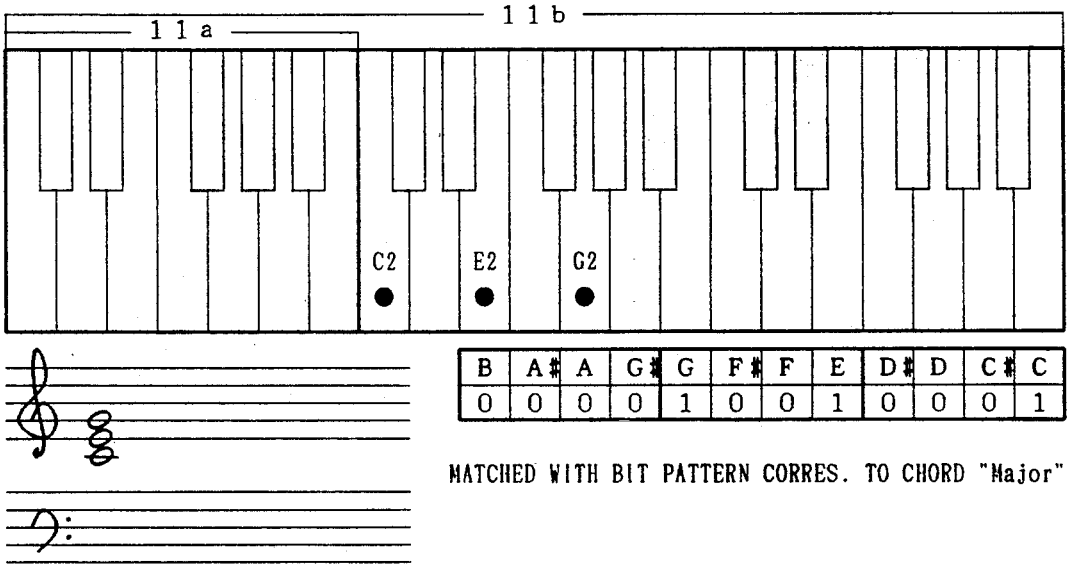
Figure 5:
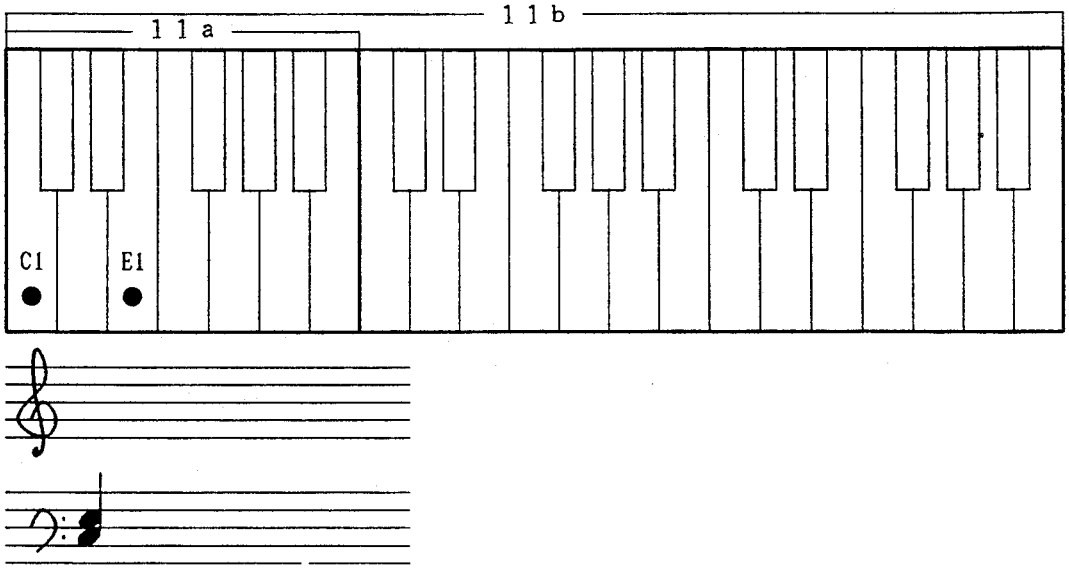
Figure 5:
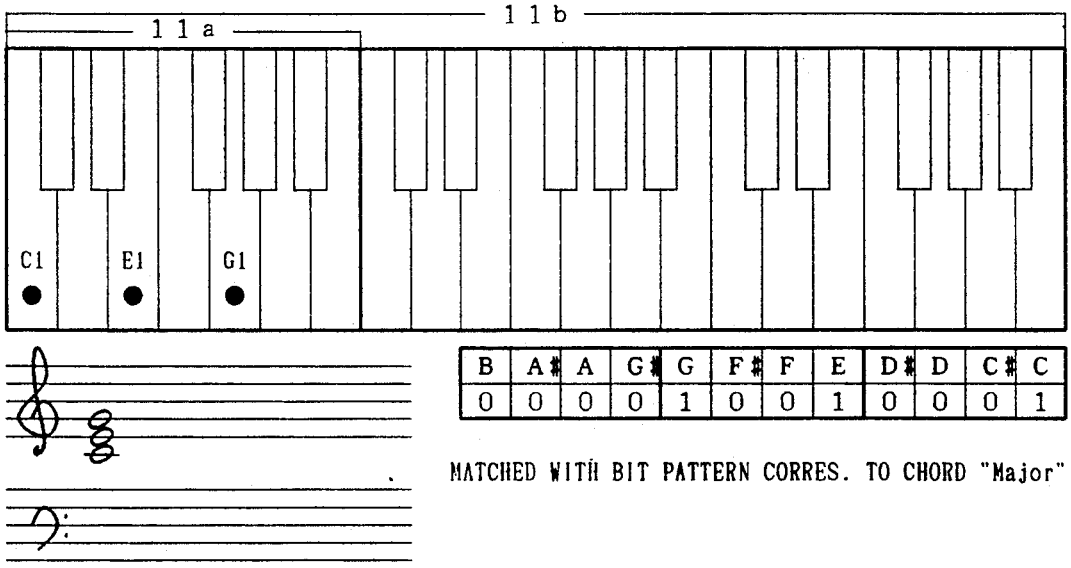
Figure 5:
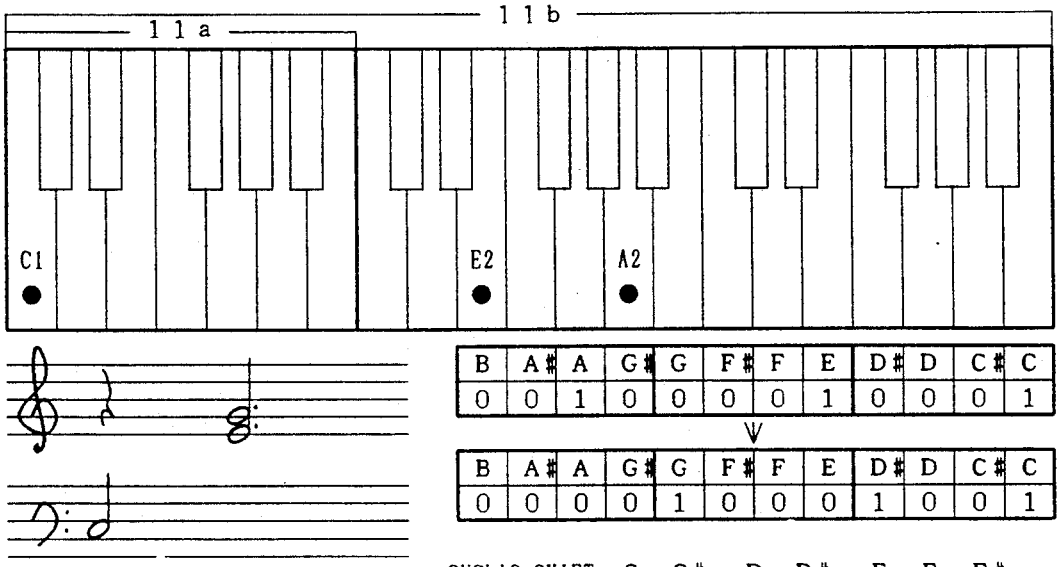
Figure 5:
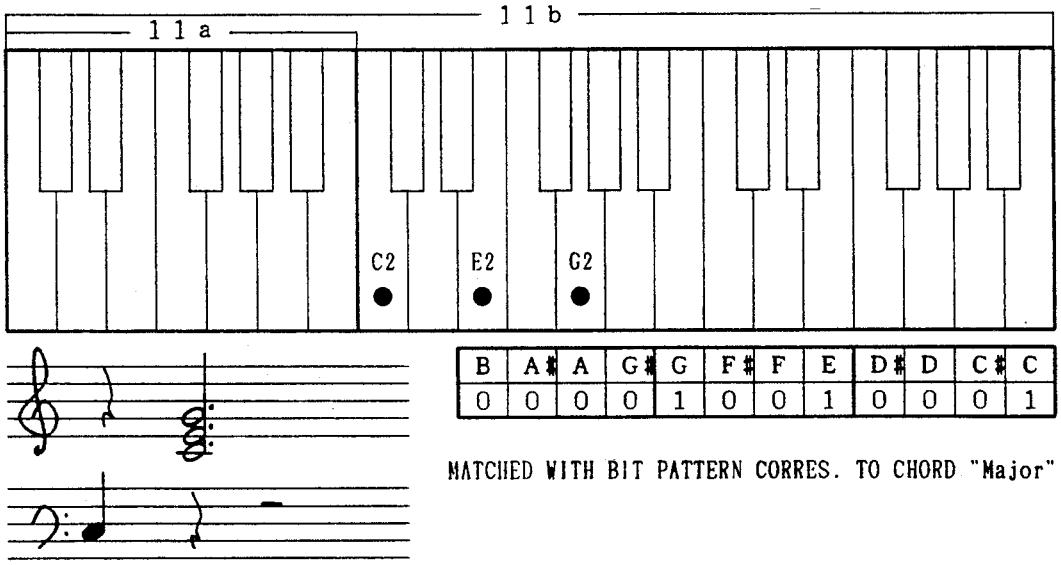
Figure 5:
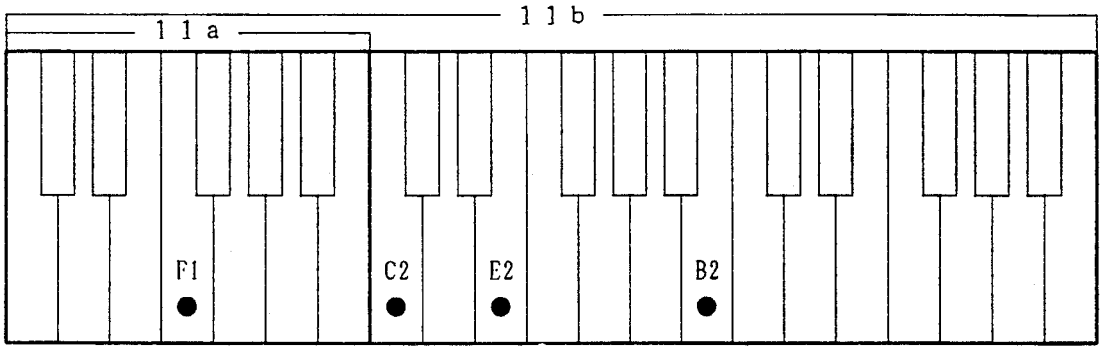
Figure 5:
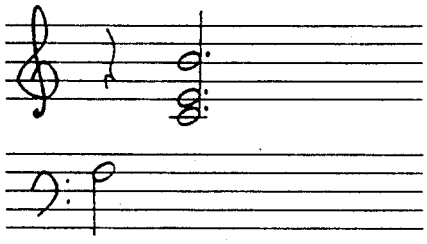

FIGS. 5(1) to 5(11) illustrate examples of the discrimination and detection processing of a bass root, a chord root, and a chord type.

FIG. 5(1) illustrates a case wherein only a key corresponding to the pitch C1 of the keyboard 11 is turned on. The key corresponding to the pitch C1 is included in the bass-root detecting portion 11*a*, and therefore, the bass root stored in the bass-root storing area is updated by replacing the formerly stored pitch with the pitch C. Further, for a chord accompaniment, less than three keys are pressed down, and thus the chord root stored in the chord-root storing area and the chord type stored in the chord-type storing area are not updated, and as a result the musical instrument continues to play the chord currently being performed. Namely, a discrimination and detection of a bass root is carried out regardless of whether or not a detection of a new chord to be used is made (namely, whether or not a chord accompaniment is changed).

FIG. 5(2) illustrates a case wherein keys corresponding to the pitches B1, E2, G2 and B2 of the keyboard 11 are turned on. The lowest pitch of these pitches corresponding to the turned-on keys in the bass-root detecting portion 11*a* is B1, and therefore, the bass root stored in the bass-root storing area is updated by replacing the formerly stored pitch with the pitch B. When synthesizing the octave-chords corresponding respectively to octave-segments in the keyboard, the pitches B1 and B2 correspond to the same pitch B, and thus bits of a synthesized octave-chord corresponding respectively to the pitches B, E and G are 1. Therefore, the resultant synthesized octave-chord has a bit pattern "1000 1001 0000".

This bit pattern of the synthesized octave-chord is not stored in the chord table 71 of FIG. 4, and thus serial ring shifts of the synthesized octave-chord are effected and it is determined whether the bit patterns of the shifted synthesized octave-chord match those stored in the chord table 71. The bit pattern "0000 1000 1001", obtained by sequentially effecting the ring shift of the synthesized octave-chord four times, is matched with that of the chord "Minor" illustrated in the table 71. In this case, the chord root of the synthesized octave-chord changes from C to E during the ring shifts, as follows C→C#D→D#E, and consequently, the pitch E is employed as the chord root, and thus a discrimination of an inverted chord can be easily effected. In this case, less than three keys of the chord-root detecting portion are pressed down, and therefore, the chord root stored in the chord-root storing area and the chord type stored in the chord-type storing area are not updated. As a result, the musical instrument continues to play a chord currently being performed.

FIG. 5(3) illustrates a case wherein keys corresponding to the pitches C1 and C1# of the keyboard 11 are turned on. In this case, the lowest pitch of the pitches corresponding to the turned-on keys in the bass-root detecting portion 11*a* is C1, and thus the bass root stored in the bass-root storing area is updated by replacing the formerly stored pitch with the pitch C. As in the former cases, less than three keys of the chord-root detecting are pressed down, and thus the stored chord root and the stored chord type are not updated. Consequently, the musical instrument continues to play a chord currently being performed.

FIG. 5(4) illustrates a case wherein keys corresponding to the pitches C1, E1 and G2 of the keyboard 11 are turned on. In this case, the lowest pitch of the pitches corresponding to the turned-on keys in the bass-root detecting portion 11*a* is C1, and thus the stored bass root is updated by changing the formerly stored pitch into the pitch C. For a chord accompaniment, a synthesized octave-chord obtained by synthesizing octave-chords corresponding respectively to octave-segments in the keyboard has a bit pattern "0000 1001 0001", in which bits corresponding to the pitches C, E and G are 1. This is the bit pattern represented by the chord bit pattern data corresponding to the chord "Major" of the chord table of FIG. 4 that matches the bit pattern of the synthesized octave-chord, and thus the chord to be performed is determined as "Major". In this case, no ring shift of the synthesized octave-chord is effected, and therefore, the chord root thereof is determined to be the pitch C.

FIG. 5(5) illustrates a case wherein keys corresponding to the pitches D1, E1, G1 and B1 of the keyboard 11 are turned on. The lowest pitch of these pitches corresponding to the turned-on keys in the bass-root detecting portion 11*a* is D1, and thus the bass root stored in the bass-root storing area is updated by changing the formerly stored pitch into the pitch D. For a chord accompaniment, a synthesized octave-chord has a bit pattern "1000 1001 0100", in which bits corresponding to the pitches D, E, G and B are 1. This bit pattern of the synthesized octave-chord is not stored in the chord table 71 of FIG. 4, and thus sequential ring shifts of the synthesized octave-chord are effected and it is determined whether the bit patterns of the shifted synthesized octave-chord match those stored in the chord table 71. The bit pattern "0100 1000 1001" obtained by sequentially effecting the ring shift of the synthesized octave-chord four times match that of the chord "Minor 7th" illustrated in the table 71, and therefore, the chord to be performed is determined as "minor 7th". In this case, the chord root of the synthesized octave-chord changes from C to E, during the ring shifts as follows: C→C#→D→D#→E, and consequently, the pitch E is employed as the chord root.

FIG. 5(6) illustrates a case wherein keys corresponding to the pitches C2, E2 and G2 of the keyboard 11 are turned on. In this case, no pressed keys exist in the bass-root detecting portion 11*a*, and therefore, the stored bass-root is not updated and a bass accompaniment currently being played is still performed. For a chord accompaniment, a synthesized octave-chord obtained by synthesizing octave-chords corresponding respectively to octave-segments in the keyboard has a bit pattern "0000 1001 0001", in which bits corresponding to the pitches C, E and G are 1. As in the case of FIG. 5(4), it is the bit pattern represented by the chord bit pattern data corresponding to the chord "Major" of the chord table of FIG. 4 that matches the bit pattern of the synthesized octave-chord, and thus the chord to be performed is determined to be "Major". In this case, the chord root thereof is determined as the pitch C, because no ring shift of the synthesized octave-chord has been effected.

FIG. 5(7) illustrates a case wherein keys corresponding to the pitches C1 and E1 of the keyboard 11 are turned on. The lowest pitch of these pitches corresponding to the turned-on keys of the bass-root detecting portion 11*a* is C1, and therefore, the bass root stored in the bass-root storing area is updated by replacing the formerly stored pitch with the pitch C. For a chord accompaniment, however, less than three keys are turned on, and thus the chord root stored in the chord-root storing area and the chord type stored in the chord-type storing area are not updated. Consequently, the musical instrument continues to play a chord currently being performed.

FIG. 5(8) illustrates a case wherein keys corresponding to the pitches C1, E1 and G1 of the keyboard 11 are turned on. In this case, the lowest pitch of the pitches corresponding to the turned-on keys in the bass-root detecting portion 11*a* is C1, and thus the stored bass root is updated by changing the formerly stored pitch to the pitch C. For a chord accompaniment, a synthesized octave-chord obtained by synthesizing octave-chords corresponding respectively to octave-segments in the keyboard has a bit pattern "0000 1001 0001", in which bits corresponding to the pitches C, E and G are 1. As described above, this is the bit pattern represented by the chord bit pattern data corresponding to the chord "Major" of the chord table of FIG. 4 that matches the bit pattern of the synthesized octave-chord, and thus the chord to be performed is determined to be "Major". In this case, no ring shift of the synthesized octave-chord is effected. and therefore, the pitch C is employed as the chord root.

FIG. 5(9) illustrates a case wherein keys corresponding to the pitches C1, E2 and A2 of the keyboard 11 are turned on. The lowest pitch of these pitches corresponding to the turned-on keys in the bass-root detecting portion 11*a* is C1, and thus the bass root stored in the bass-root storing area is updated by changing the formerly stored pitch to the pitch C. For a chord accompaniment, a synthesized octave-chord has a bit pattern "0010 0001 0001", in which bits corresponding to the pitches C, E and A are 1. This bit pattern of the synthesized octave-chord is not stored in the chord table 71 of FIG. 4, and thus sequential ring shifts of the synthesized octave-chord are effected and it is determined whether the bit patterns of the shifted synthesized octave-chord matches those stored in the chord table 71. The bit pattern "0000 1000 1001", obtained by sequentially effecting the ring shift of the synthesized octave-chord nine times, is matched with that of the chord "Minor" illustrated in the table 71, and therefore, the chord to be performed is determined to be "Minor". In this case, the chord root of the synthesized octave-chord changes, during the ring shifts, as follows: C→C#→D→D#→E→F→F#→G→G#→A, and consequently, the pitch A is employed as the chord root.

FIG. 5(10) illustrates a case wherein keys corresponding to the pitches C2, E2 and G2 of the keyboard 11 are turned on, and thus, since no pressed keys exist in the bass-root detecting portion 11*a*, the stored bass-root is not updated, and consequently, a bass accompaniment currently being played is still performed. For a chord accompaniment, a synthesized octave-chord obtained by synthesizing octave-chords corresponding respectively to octave-segments in the keyboard has a bit pattern "0000 1001 0001", in which bits corresponding to the pitches C, E and G are 1. As in case of FIG. 5(6), this is the bit pattern represented by the chord bit pattern data corresponding to the chord "Major" of the chord table of FIG. 4 that matches the bit pattern of the synthesized octave-chord, and thus the chord to be performed is determined to be "Major". In this case, the chord root thereof is determined as the pitch C because a ring shift of the synthesized octave-chord is not performed.

FIG. 5(11) illustrates a case wherein keys corresponding to the pitches F1, C2, E2 and B2 of the keyboard 11 are turned on. The lowest pitch of these pitches corresponding to the turned-on keys in the bass-root detecting portion 11*a* is F1, and thus the bass root stored in the bass-root storing area is updated by changing the formerly stored pitch to the pitch F. For a chord accompaniment, a synthesized octave-chord has a bit pattern "1000 0001 0001", in which bits corresponding to the pitches C, E and B are 1. Nevertheless, there is no chord which includes adjoining pitches B and C and thus a chord of which the corresponding chord bit pattern data has a bit pattern matching the bit pattern of the synthesized octave-chord can not be found, even though many ring shifts of the synthesized octave-chord are effected. Namely, the detection of a new chord cannot be made. Nevertheless, a chord accompaniment is performed by using the pitches F1, C2, E2 and B2 corresponding to the turned-on keys, and using the time values based on the pattern indicated by the automatic chord accompaniment data.

Although a preferred embodiment of the present invention has been described above, it is to be understood that the present invention is not limited thereto and that other modifications will be apparent to those skilled in the art without departing from the spirit of the invention. For example, the difference between the highest and lowest pitch of pitches corresponding to keys of the bass-root detecting portion may be equal to or more than one octave-segment. Further, the difference between the highest and lowest pitch of pitches corresponding to keys of the chord-root detecting portion may have a value (e.g., 49 keys or 61 keys) other than three octave-segments. Furthermore, the bass-root detecting portion 11*a* may be provided in a part of the chord-root detecting portion 11 corresponding to high pitches, or the bass-root detecting portion 11*a* may be provided in such a manner that it does not overlap the chord-root detecting portion 11*b*. The electronic musical instrument may be adapted to detect a kind of accompaniment (e.g., a backing accompaniment) other than a bass and chord accompaniments. Moreover, the electronic musical instrument may be adapted to perform any kind of chord (e.g., an arpeggio) as an accompaniment. Further, a ratio of keys of the chord-root detecting portion 11*b* to keys of the bass-root detecting portion 11*a* may be larger than the value of the ratio used in the above described embodiment. Also, addition to the bass-root detecting portion 11*a* and the chord-root detecting portion 11*b*, a melody performing portion may be provided in the keyboard. Further, instead of effecting a ring shift of a synthesized octave-chord, a ring shift of chord bit pattern data of the chord table 71 may be carried out, to detect a chord corresponding to a bit pattern matched with the bit pattern of the synthesized octave-chord in the root-position or in an inversion thereof. With regard to the hardware, the bass-root storing area 61*a*, the chord-root storing area 61*b*, the chord-type storing area 61*c* and the octave-chord register may be constructed by a register, a counter, a register and a ring counter, respectively, in the working memory 61. In said step S6, the synthesized octave-chord data may be inverted and in said step S9, the chord bit pattern data of each chord may be inverted.

The scope of the present invention, therefore, is to be determined solely by the appended claims.

What we claim is:

1. A device for detecting contents of an accompaniment comprising:

a plurality of first pitch indicating means for indicating pitches of musical tones and for detecting a bass root to be performed as a first accompaniment;

a plurality of second pitch indicating means for indicating pitches of musical tones and for detecting a chord type and a chord root to be performed as a second accompaniment, said plurality of second pitch indicating means including said first pitch indicating means;

pitch detecting means for detecting pitches indicated by said first pitch indicating means and said second pitch indicating means;

chord type detecting means for detecting the chord type according to the pitches detected by said pitch detecting means;

chord root detecting means for detecting the chord root by comparing the pitches detected by said pitch detecting means to a plurality of chord bit patterns stored in a memory;

lowest pitch detecting means for detecting the lowest pitch indicated by said first pitch indicating means; and bass detecting means for detecting the bass root according to the lowest pitch detected by said the lowest pitch detecting means;

wherein said chord root detecting means and said bass detecting means detect the chord root and bass root independent of each other.

2. The device of claim 1, wherein said plurality of second pitch indicating means is larger than said plurality of first pitch indicating means.

3. The device of claim 1, wherein said bass detecting means detects the bass root according to the lowest pitch detected by said lower pitch detecting means, if the lowest pitch is indicated as a new key on.

4. The device of claim 1, further comprising a plurality of melody pitch indicating means for indicating pitches of musical tones of a melody.

5. The device of claim 1, further comprising tone generating means for generating musical tones represented by the chord root and the bass root.

6. The device of claim 1, wherein said plurality of first pitch indicating means and said plurality of second pitch indicating means are keys of a keyboard.

7. The device of claim 1, wherein said plurality of first pitch indicating means and said plurality of second pitch indicating means are strings of a string instrument.

8. The device of claim 1, wherein said plurality of first pitch indicating means and said plurality of second pitch indicating means are fingerings of a wind instrument.

9. A device for independently generating a bass accompaniment and a chord accompaniment, comprising:

pitch selecting means including, bass root selecting means, including a plurality of bass root selecting keys, and chord selecting means, including a plurality of chord selecting keys;

bass root setting means for setting a bass root equal to a lowest pitch corresponding to one of the plurality of bass root selecting keys selected by an operator;

chord root setting means for setting a chord root and a chord type, independent of the bass root, including, bit pattern generating means for generating an input bit pattern corresponding to the plurality of chord selecting keys selected by the operator, storage means for storing a plurality of bit patterns representing chords and chord types, comparing means for comparing the input bit pattern to each of the plurality of bit patterns stored in said storage means and if a match is found, setting the chord root and chord type of the input bit pattern equal to the chord root and the chord type of the matched one of the plurality of bit patterns, and ring-shifting means for ring-shifting the input bit pattern until the ring-shifted input bit pattern matches one of the plurality of bit patterns stored in said storage means and setting the chord root and chord type of the ring-shifted input bit pattern equal to the chord root and chord type of the matched one of the plurality of bit patterns; and tone generating means for generating the bass accompaniment from the bass root corresponding to the bass root selecting keys selected by the operator and for generating the chord accompaniment from the chord root and chord type corresponding to the plurality of chord selecting keys selected by the operator.

10. The device of claim 9, wherein said chord selecting means further includes the plurality of bass root selecting keys.

11. The device of claim 9, wherein the bass root is set by said bass root setting means even if none of the plurality of chord selecting keys are selected by the operator.

12. The device of claim 9, wherein the chord type said chord root is set by said chord root setting means even if none of the plurality of bass root selecting keys are selected by the operator.

13. The device of claim 9, wherein said chord root setting means does not set the chord root and chord type if less than three of the plurality of bass root selecting keys and chord selecting keys are selected by the operator.

14. The device of claim 10, wherein said chord root setting means does not set the chord root and chord type if less than three of the plurality of bass root selecting keys and chord selecting keys are selected by the operator.

15. The device of claim 11, wherein said chord root setting means does not set the chord root and chord type if less than three of the plurality of bass root selecting keys and chord selecting keys are selected by the operator.

16. The device of claim 15, wherein said chord root setting means does not set the chord root and chord type if less than three of the plurality of bass root selecting keys and chord selecting keys are selected by the operator.

17. The device of claim 9, wherein when the ring-shifted input pattern fails to match any of the plurality of bit patterns stored in said storage means, said tone generating means generates the chord accompaniment from the pitches corresponding to the plurality of chord selecting keys selected by the operator.

18. The devices of claim 9, said pitch selecting means further including melody selecting means including a plurality of melody selecting keys.

19. A method of independently generating a bass accompaniment and a chord accompaniment, comprising the steps of:

(a) setting a bass root equal to a lowest pitch corresponding to one of the plurality of bass root selecting keys selected by an operator;

(b) storing a plurality of bit patterns representing chords and chord types;

(c) setting a chord root and a chord type, independent of the bass root, including the sub-steps of, (c) (1) generating an input bit pattern corresponding to the plurality of chord selecting keys selected by the operator, (c) (2) comparing the input bit pattern to each of the plurality of stored bit patterns and if a match is found, setting the chord root and chord type of the input bit pattern equal to the chord root and the chord type of the matched one of the plurality of stored bit patterns, and (c) (3) ring-shifting the input bit pattern until the ring-shifted input bit pattern matches one of the plurality of stored bit patterns and setting the chord root and chord type of the ring-shifted input bit pattern equal to the chord root and chord type of the matched one of the plurality of stored bit patterns; and (d) generating the bass accompaniment from the bass root corresponding to the bass root selecting keys selected by the operator and for generating the chord accompaniment from the chord root and chord type corresponding to the plurality of chord selecting keys selected by the operator.

20. The method of claim 19, wherein said chord selecting means further includes the plurality of bass root selecting keys.

21. The method of claim 19, wherein the bass root is set by said bass root setting means even if none of the plurality of chord selecting keys are selected by the operator.

22. The method of claim 19 wherein the chord type and chord root is set in step (c) even if none of the plurality of bass root selecting keys are selected by the operator.

23. The device of claim 19, wherein the chord root and chord type are not set in step (c) if less than three of the plurality of bass root selecting keys and chord selecting keys are selected by the operator.

24. The device of claim 20, wherein the chord root and chord type are not set in step (c) if less than three of the plurality of bass root selecting keys and chord selecting keys are selected by the operator.

25. The device of claim 21, wherein the chord root and chord type are not set in step (c) if less than three of the plurality of bass root selecting keys and chord selecting keys are selected by the operator.

26. The device of claim 22, wherein the chord root and chord type are not set in step (c) if less than three of the plurality of bass root selecting keys and chord selecting keys are selected by the operator.

27. The method of claim 19, wherein when the ring-shifted input pattern fails to match any of the plurality of stored bit patterns, the chord accompaniment is generated in step (d) from the pitches corresponding to the plurality of chord selecting keys selected by the operator.

28. A method of detecting contents of an accompaniment comprising the steps of:

(A) indicating first pitches of a musical tone by each of a plurality of first pitch indicating means for detecting a bass root to be performed as a first accompaniment;

(B) indicating second pitches of the musical tone by each of a plurality of second pitch indicating means for detecting a chord type and a chord root to be performed as a second accompaniment, said plurality of second pitch indicating means including said pluraity of first pitch indicating means;

(C) detecting said first and second pitches indicated by said first pitch indicating means in said step (A) and said second pitch indicating means in said step (A);

(D) detecting said chord type according to said first and second pitches detected in said step (C);

(E) detecting said chord root by comparing said first and second pitches detected in said step (C) to a plurality of chord bit patterns stored in a memory;

(F) detecting a lowest pitch indicated by said first pitch indicating means in said step (A); and (G) detecting said bass root according to the lowest pitch detected in said step (F);

wherein detecting said chord root in said step (E) and detecting said bass root in said step (G) are performed independent of each other.

29. The method of claim 28, wherein a number of said plurality of second pitch indicating means is larger than a number of said plurality of first pitch indicating means.

30. The method of claim 28, wherein said step (G) detects said bass root according to the lowest pitch, if the lowest pitch is indicated as a new key-on.

31. The method of claim 28, further comprising the step of:

(H) indicating pitches of the musical tone which comprise a melody.

32. The method of claim 28, further comprising the step of:

(H) generating musical tones represented by said chord root and said bass root.

33. The method of claim 28, wherein said plurality of first pitch indicating means and said plurality of second pitch indicating means are keys of a keyboard.

34. The method of claim 28, wherein said plurality of first pitch indicating means and said plurality of second pitch indicating means are strings of a string instrument.

35. The method of claim 28, wherein said plurality of first pitch indicating means and said plurality of second pitch indicating means are fingerings of a wind instrument.

* * * * *